US008213653B2

(12) United States Patent
Von Buol et al.

(10) Patent No.: US 8,213,653 B2
(45) Date of Patent: Jul. 3, 2012

(54) HEARING DEVICE

(75) Inventors: Andreas Von Buol, Zürich (CH); Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 1448 days.

(21) Appl. No.: 11/382,501

(22) Filed: May 10, 2006

(65) Prior Publication Data

US 2007/0263891 A1 Nov. 15, 2007

(51) Int. Cl.
*H04R 25/00* (2006.01)

(52) U.S. Cl. ..... 381/321; 381/94.8; 381/104; 381/106; 381/107

(58) Field of Classification Search ..... 381/320–321, 381/94.8, 104, 106–107, 321–321; 380/320–321
See application file for complete search history.

(56) References Cited

U.S. PATENT DOCUMENTS

| | | | | |
|---|---|---|---|---|
| 5,278,912 | A | 1/1994 | Waldhauer | |
| 5,488,668 | A | 1/1996 | Waldhauer | |
| 5,706,352 | A * | 1/1998 | Engebretson et al. | 381/312 |
| 6,970,570 | B2 * | 11/2005 | Goldstein | 381/321 |
| 2004/0179694 | A1 * | 9/2004 | Alley | 381/55 |
| 2005/0094824 | A1 * | 5/2005 | Chuang | 381/72 |
| 2008/0292122 | A1 * | 11/2008 | Nordahn et al. | 381/321 |

FOREIGN PATENT DOCUMENTS

| | | | |
|---|---|---|---|
| EP | 0590903 | A1 | 4/1994 |
| EP | 0836363 | A1 | 4/1998 |
| GB | 2074817 | A | 11/1981 |
| WO | 01/76063 | A2 | 10/2001 |

OTHER PUBLICATIONS

European Search Report, EP06113762, Oct. 19, 2006.

* cited by examiner

*Primary Examiner* — Suhan Ni
*Assistant Examiner* — Ryan Robinson
(74) *Attorney, Agent, or Firm* — Pearne & Gordon LLP

(57) ABSTRACT

The hearing device to be worn by a user of the hearing device comprises an input transducer for transducing incoming acoustical sound into audio signals;

a signal processor for processing audio signals;

an output transducer for transducing audio signals into outgoing acoustical sound.

Said signal processor is designed such that there exists an input SPL range of at least a portion of said incoming acoustical sound, in which an increase in input SPL of said at least one portion of said incoming acoustical sound results in a decrease in output SPL of at least a portion of said outgoing acoustical sound, wherein SPL stands for sound pressure level. Through this, at high input SPL the hearing device's power consumption can be reduced by making use of direct sound, which propagate as sound waves from outside the user's ear canal to the user's ear drum.

27 Claims, 7 Drawing Sheets

HEARING DEVICE

TECHNICAL FIELD

The invention relates to a hearing device. The hearing device can be a hearing aid, a headphone, an earphone, a hearing protection device, a communication device or the like. The hearing device may be worn in or near a user's ear or implanted. The invention relates furthermore to a signal processor for processing audio signals in a hearing device, to a method of operating a hearing device and to a method of fitting a hearing device.

BACKGROUND OF THE INVENTION

In U.S. Pat. No. 5,278,912 and U.S. Pat. No. 5,488,668, audio compressors for use in hearing aids are disclosed. Such compression systems may work individually on a number of frequency bands.

In EP 0' 590' 903 B1 an output limiter for hearing aid amplifiers is disclosed.

In EP 0' 836' 363 B1, a loudness limiter is disclosed, by means of which the loudness of a signal transmitted to the human ear by a hearing apparatus can be restricted to a maximum acceptable loudness level.

SUMMARY OF THE INVENTION

A goal of the invention is to create a hearing device that has an improved performance in loud environments or at high signal pressure levels (SPLs).

Another goal of the invention is to provide for a signal processor useful in a hearing device, having advanced features and allowing for an improved performance.

Another goal of the invention is to provide for an improved method of operating a hearing device, in particular a method allowing for an improved performance in loud environments or at high signal pressure levels.

Another goal of the invention is to provide for an improved method of fitting a hearing device, in particular a method allowing for an improved performance of the hearing device in loud environments or at high signal pressure levels.

One object of the invention is to decrease the power consumption of a hearing device. The lifetime of a power supply of the hearing device (typically a battery) may be increased.

Another object of the invention is to achieve an improved acoustic performance of a hearing device.

Another object of the invention is to reduce a hearing device user's perception of distortions in a hearing device.

These objects are achieved by a hearing device, a signal processor and by a method of operating a hearing device and by a method of fitting a hearing device according to the patent claims.

The hearing device comprises

- an input transducer for transducing incoming signals into audio signals;
- a signal processor for processing audio signals;
- an output transducer for transducing audio signals into outgoing acoustical sound;

and said signal processor is designed (or programmed) such that there exists an input level range of at least a portion of said incoming signal, in which an increase in input level of said at least one portion of said incoming signal results in a decrease in output level of at least a portion of said outgoing acoustical sound.

In an important embodiment,

- said incoming signals are incoming acoustical sound;
- said input level range is an input SPL range;
- said increase in input level is an increase in input SPL;
- said decrease in output level is a decrease in output SPL;

wherein SPL stands for sound pressure level. Accordingly, in this important embodiment, the hearing device to be worn by a user of the hearing device, comprises

- an input transducer for transducing incoming acoustical sound into audio signals;
- a signal processor for processing audio signals;
- an output transducer for transducing audio signals into outgoing acoustical sound;

wherein said signal processor is designed such that there exists an input SPL range of at least a portion of said incoming acoustical sound, in which an increase in input SPL of said at least one portion of said incoming acoustical sound results in a decrease in output SPL of at least a portion of said outgoing acoustical sound, wherein SPL stands for sound pressure level.

In other embodiments, the incoming signal may, e.g., be an electromagnetic signal, e.g., a radio frequency signal. In such a case, said input transducer may convert incoming signals, which already are audio signals, into audio signals in a form suitable for being used within the hearing device.

Due to the importance and advantages of the above-mentioned important embodiment, in the following, the invention and possible embodiments are described with respect to said important embodiment. Nevertheless, the description may be applied to the broader scope of the invention as well. Replacing (mentally) the "SPLs" by "levels" and "input acoustical sound" by "input signals" in the appropriate places in the text below, will yield the corresponding examples and descriptions in the broader scope of the invention.

The invention may be seen in that, for a certain range of input SPLs, the input-SPL-to-output-SPL-characteristic of the hearing device has a negative slope: In that range, the output SPL is the smaller the larger the input SPL is.

Through this, an additional way of dynamics processing is created besides the known expansion, compression and limiting.

This way of dynamics processing is particularly useful in loud environments. In loud environments, the SPL of direct sound, i.e., of sound that propagates as sound waves (acoustic waves) from outside the user's ear canal to the user's ear drum (or other sensing element of the ear), can be considerably high. That direct sound SPL can become comparable to or even higher than sound provided to the user via the hearing device, in which case said sound provided to the user via the hearing device may be reduced or even muted.

In a primary view of the invention, the sound source of said direct sound and the sound source of the audio signals within the hearing device are identical. In that case, said reducing or muting of the sound provided to the user via the hearing device may be done in favour of said direct sound, which then can partially or completely replace said sound provided to the user via the hearing device.

In another possible view of the invention, the sound source of said direct sound and the sound source of the audio signals within the hearing device are not identical. In that case, said reducing or muting of the sound provided to the user via the hearing device may, e.g., be accomplished in order to save energy in the hearing device when the user would anyway not be able to properly perceive the outgoing acoustical sound, because the direct sound is too loud (masking of outgoing acoustical sound from the hearing device by direct sound). For example, if the user attends a loud rock concert and meanwhile receives a telephone call on his mobile phone, the voice on the mobile phone, received in the hearing device by a telephone coil in the hearing device, can be suppressed (optionally in certain frequency bands) whenever the rock music is particularly loud (optionally in said certain frequency bands).

Said direct sound partially propagates through the user's head (bones) and partially propagates through the user's ear canal. The latter part is the larger the less the ear canal is blocked. It can be particularly large, e.g., in case of large vents and in case of a hearing device with an open fitting (open canal device). A vent is a channel-like opening in a part of a hearing device worn in the ear canal, which is usually meant to equalize pressure differences between the inside of the ear canal and the outside. The invention can also be used in conjunction with a closed fitting and/or with a very small or a possibly blocked vent. In that case, the attenuation of direct sound typically is typically about 30 dB to 40 dB.

It is possible to describe "direct sound" as sound that acoustically bypasses the electrical path in the hearing device.

Audio signals are electrical signals (analog and/or digital), which are obtained from acoustical sound (sound waves) through conversion and possibly further processing; i.e., they represent sound.

Said incoming acoustical sound usually is acoustic waves in the environment in which the hearing device user is located.

Said input transducer is typically a mechanical-to-electrical converter, in particular a microphone. The hearing device may, of course, comprise more than one input transducer, e.g., two or three.

Said output transducer is typically an electrical-to-mechanical transducer, in particular a loudspeaker, in the field of hearing aids also named "receiver".

Said signal processor typically is a digital signal processor (DSP), possibly realized in form or an software-programmed processor, but may be analogue or analogue-digital hybride. In a simple form, the processor is basically an amplifier, wherein "amplifying" may include attenuating as well.

Said audio signals processed by said signal processor are derived from said audio signals, which are derived from said incoming acoustical sound by said input transducer.

Said audio signals transduced by said output transducer are derived from the output of said signal processor.

Said outgoing acoustical sound is to be presented to the user. More precisely, said outgoing acoustical sound is to be presented to a sensing element of an ear of a user of the hearing device. Said sensing element typically is an ear drum; it may be a part of the inner ear, in particular a part of the cochlear (in particular if the hearing device is or comprises an implant).

Said portion of said incoming acoustical sound may be identical with said incoming acoustical sound or, more precisely, with that portion of it, which is transduced by said input transducer. Or, said portion may be defined by a certain frequency range or by a certain class of signals obtained in a classification process, or by others. Classification is well known, e.g., in the field of hearing aids, and allows to classify acoustic events not only with respect to its frequency spectrum, but also, e.g., with respect to its time structure (impulse-like sounds versus constant or repetitive sounds).

Basically the same applies for said portion of said outgoing acoustical sound: It may be identical with said outgoing acoustical sound (as transduced by said output transducer), or it may be a portion defined by a certain frequency range or by a certain class of signals obtained in a classification process, or by others.

In one embodiment, there exists an SPL, above which the output of said least one portion of said outgoing acoustical sound is muted (fully suppressed). This allows to save energy, in particular energy consumed by said output transducer. The energy savings can be particularly high when said portion of said outgoing acoustical sound comprises or consists of low frequencies (typically below 300 Hz or below 100 Hz).

In one embodiment, said input SPL range has a lower limit, referred to as input threshold SPL. In particular, said input SPL range may extend from said input threshold SPL to higher SPLs; the range can be open towards high SPLs.

Said input threshold SPL can be chosen according to various criteria and requirements:

In one embodiment, said input threshold SPL is chosen such that an SPL of a superposition of said outgoing acoustical sound and direct sound near the user's ear drum (or other sensing element of the ear) is below the user's uncomfortable level (UCL). It is also possible to refer to the threshold of pain instead of the UCL as a reference for defining or adjusting the gain curve of the hearing device. Said UCL is typically in the range between 100 dB and 120 dB, but may be in the range between 80 dB and 140 dB. It is possible to choose the input-SPL-to-output-SPL characteristic such that the SPL of said superposition does at no input SPL reach or exceed the UCL, at least not as long as the SPL of direct sound alone does not exceed the UCL. For a suppression of direct sound, it is referred to a special embodiment described below (in the detailed description).

In one embodiment, said input threshold SPL is an input SPL for which the corresponding output SPL (of said portion of outgoing acoustical sound) in dB minus the corresponding SPL of direct sound near the user's ear drum (or other sensing element of the ear) in dB is smaller than or equal to +6 dB (or +3 dB). I.e., the negative slope of the input-SPL-to-output-SPL-characteristic of the hearing device may set in as soon as the direct sound is just a bit softer than the outgoing acoustical sound of the hearing device. Said setting-in of said negative slope may take place at smaller differences (output SPL in dB minus direct sound SPL in dB), e.g., when direct sound and outgoing acoustical sound of the hearing device are equal (0 dB difference) or when the direct sound is somewhat louder than the outgoing acoustical sound (e.g., −6 dB difference), or when the direct sound is even louder than that. And said negative slope may set in at any difference in between the named differences. Such a choice of the inset of said negative slope will usually allow to make good use of the direct sound and to save reasonable amounts of energy. The smaller said input threshold SPL is chosen compared to said SPL of direct sound, the smaller the negative slope of the input-SPL-to-output-SPL-characteristic of the hearing device may be chosen, which allows to avoid a noticeable reduction of loudness with increasing input SPL. This way, the occurrence of disturbing loudness changes near or above said input threshold SPL (i.e., at the inset of the negative slope or within the range of the negative slope) can be prevented.

In one embodiment, said input threshold SPL is chosen equal to an input SPL which is, within 6 dB (or 3 dB), equal to its corresponding output SPL. This way, the inset of said negative slope is chosen in a region where the (SPL-related) gain of the hearing device is about one.

In one embodiment, said input threshold SPL is chosen smaller than or equal to a maximum input SPL (MPI), wherein said input transducer will tend to produce distorted input audio signals for input SPLs of said at least one portion of said incoming acoustical sound above said maximum input SPL. I.e., the input threshold SPL is chosen such that it can be prevented that the user would perceive distortions stemming from exposing said input transducer to too high SPLs. The output SPL for (presumably) distorted sounds can be muted or chosen so low that distorted portions of sound are masked by other sound portions (of outgoing acoustical sound and/or of direct sound). The perceptions of distortions can be avoided, and an improved acoustical performance is achieved.

Analogously, in one embodiment, said input threshold SPL is chosen such that, as output SPL of said at least one portion of said outgoing acoustical sound, at most a maximum output SPL (MPO) is reached, wherein said output transducer will tend to produce distorted outgoing acoustical sound for output SPLs of said at least one portion of said outgoing acoustical sound above said maximum output SPL. I.e., the input threshold SPL is chosen such that it can be prevented that the user would perceive distortions stemming from demanding too much SPL from said output transducer. Distortion can be avoided, and an improved acoustical performance is achieved.

Combining these two distortion-minimizing embodiments leads towards a virtually distortion-free hearing device.

In one embodiment, said decrease in output SPL is chosen such, that an SPL of a superposition of said outgoing acoustical sound and direct sound near the user's ear drum (or other sensing element of the ear) is, within ±6 dB, in particular within ±3 dB, a constant for input SPLs of said at least one portion of said incoming acoustical sound above said input threshold SPL, as far as the corresponding SPL of said direct sound is not larger than said constant, wherein said direct sound is incoming acoustical sound reaching the user's ear drum (or other sensing element of the ear). In other words, the SPL of the superposition of direct sound and sound output from the hearing device is approximately constant for input SPLs above the input threshold SPL, at least insofar as the direct sound is not too loud, i.e. louder than said constant. If the direct sound is louder than said constant, it is nevertheless possible, namely by means of the special embodiment described below (in the detailed description), to let the SPL of said superposition remain constant at even higher input SPLs, i.e., the size of the interval within which SPL of the superposition is approximately constant can be enlarged.

Usually, for all input SPLs of said at least one portion of said incoming acoustical sound above said input threshold SPL, the corresponding output SPL of said at least one portion of said outgoing acoustical sound is at most as large as, in particular smaller than, the largest output SPL of said at least one portion of said outgoing acoustical sound corresponding to any input SPL of said at least one portion of said incoming acoustical sound equal to or below said input threshold SPL. In other words, usually, the highest output SPL of all output SPL values belonging to an input SPL above the input threshold SPL is smaller than (or, optionally, equal to) the highest output SPL of all output SPL values belonging to an input SPL below the input threshold SPL.

In one embodiment, the output SPL of said at least one portion of said outgoing acoustical sound is decreasing (and optionally remaining constant) with increasing input SPL of said at least one portion of said incoming acoustical sound for all input SPLs of said at least one portion of said incoming acoustical sound above said input threshold SPL. In other words, there is no increase of output SPL above a certain input SPL (the input threshold SPL).

The above-mentioned negative slope of input-SPL-to-output-SPL-characteristics of the hearing device is typically only dependent on the input SPL (or, which is equivalent, on a magnitude depending in the input SPL), but not solely from other magnitudes, like a signal-to-noise ratio or a classification result.

In one embodiment, the hearing device is an open canal device. In that case, the amount of direct sound is rather high, so that by means of the invention, the acoustical performance and the power consumption can be greatly improved. The user may take advantage of direct sound.

In one embodiment, the hearing device is a hearing aid. By means of the invention, the acoustical performance and the power consumption can be greatly improved, since hearing aids mostly have to provide for high gains and high output SPLs, and, at high input SPLs, the invention will allow to reduce the output SPL that has to be provided for by the hearing device.

In one embodiment, said at least one portion of said incoming acoustical sound is obtained by filtering in at least a first frequency range.

In one embodiment, said at least one portion of said outgoing acoustical sound is obtained by filtering in at least a second frequency range.

The above-mentioned negative slope of input-SPL-to-output-SPL-characteristics of the hearing device may be applied individually to various frequency ranges (frequency bands). These may be predetermined or automatically selected frequency bands.

The above-mentioned filtering may be band-pass filtering, highpass filtering, lowpass filtering or others, in which case said frequency range designates frequencies, which may pass; or it may be band-stop filtering or the like, in which case the frequency range designates frequencies, which are rejected.

In one embodiment, said first and second frequency ranges are identical and, in particular, both designate either frequencies, which are rejected or frequencies, which may pass.

In one possible embodiment, in which said portions of incoming/outgoing sound are frequency bands, said signal processor is designed such that there exists, for each of a multitude (typically between 3 and 15) of frequency bands, an input level (SPL) range of the portion of said incoming signal within the corresponding frequency band, in which portion an increase in input level (SPL) of said portion of said incoming signal within said corresponding frequency band results in a decrease in output level (SPL) of the portion of said outgoing acoustical sound within said corresponding frequency band. In other words, a negative slope of the input-SPL-to-output-SPL-characteristics of the hearing device may be applied to each of a multitude of frequency bands. It is possible to select said input level (SPL) ranges and said input threshold levels (SPLs) independently for different frequency bands.

The signal processor for processing audio signals in a hearing device has a non-linear input level-output level characteristic, which comprises an input level range in which an increase in input level corresponds to a decrease in output level. In terms of an input level-gain characteristic of the signal processor, there is an input level range, in which an increase in input level corresponds to a superproportional decrease of the gain (slope<−1).

The advantages of the signal processor correspond to the advantages of the corresponding hearing device.

The method of operating a hearing device comprises the steps of

- receiving incoming acoustical sound;
- transducing said incoming acoustical sound into audio signals;
- processing audio signals;
- transducing audio signals into outgoing acoustical sound to be presented to a user of the hearing device; and
- changing a level of audio signals obtained from said incoming acoustical sound in such a way that an increase in input SPL of at least one portion of said incoming acoustical sound results in a decrease in output SPL of at least a portion of said outgoing acoustical sound.

The method of fitting a hearing device, which comprises an input transducer for transducing incoming acoustic sound into audio sound, comprises the step of adjusting a parameter of a signal processor of said hearing device, which processor is designed such that there exists an input SPL range of at least a portion of said incoming acoustical sound, in which an increase in input SPL of said at least one portion of said incoming acoustical sound results in a decrease in output SPL of at least a portion of said outgoing acoustical sound.

Said parameter may be one of the group comprising an input threshold SPL limiting said input SPL range;

an input SPL, above which the output of said least one portion of said outgoing acoustical sound is muted;

a parameter of a parameter set describing to which extent and/or in which form said decrease in output SPL of said at least a portion of said outgoing acoustical sound depends on said increase in input SPL of said at least one portion of said incoming acoustical sound.

The advantages of the methods correspond to the advantages of corresponding apparatuses.

It should be noted that the invention usually relates to dynamics processing for wanted signal (useful signal; as opposed to noise=unwanted signal) or such signal plus noise. But it usually does not relate to noise (=signals considered to represent noise) alone, although it may in general be used for any kind of signal or noise. In other words, the superproportional gain (or level) decrease is not applied typically exclusively to signals that are considered (prevailingly) noise or unwanted signally.

Further preferred embodiments and advantages emerge from the dependent claims and the figures.

BRIEF DESCRIPTION OF THE DRAWINGS

Below, the invention is described in more detail by means of examples and the included drawings. The figures show.

The reference symbols used in the figures and their meaning are summarized in the list of reference symbols. Generally, alike or alike-functioning parts are given the same or similar reference symbols. The described embodiments are meant as examples and shall not confine the invention.

DETAILED DESCRIPTION OF THE INVENTION

Figure 1:
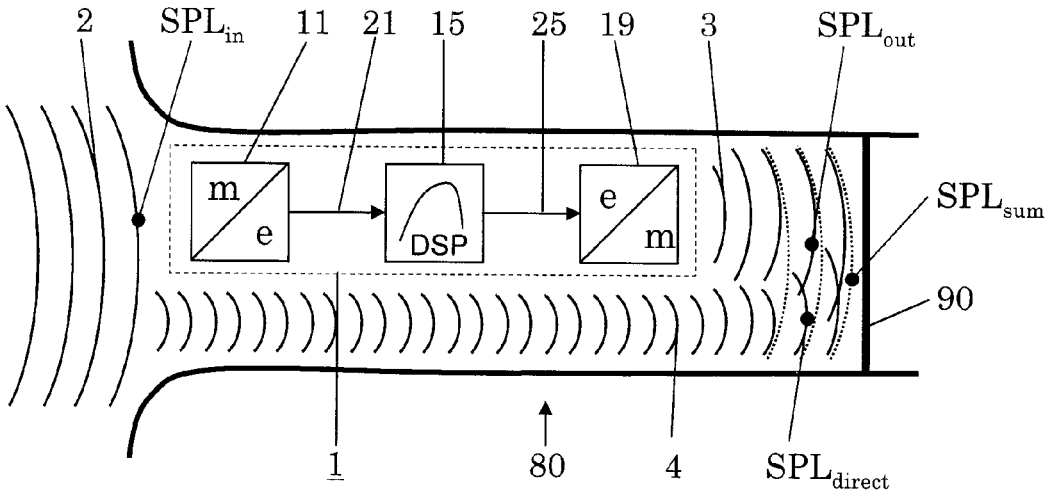
FIG. 1 a hearing device in an ear canal, schematically.

FIG. 1 shows schematically a hearing device 1 in an ear canal 80 of a user of the hearing device 1. The hearing device 1 comprises an input transducer 11, typically a microphone, a signal processor 15, typically a digital signal processor DSP, and an output transducer 19, typically a loudspeaker. The signal processor 15 is functionally interconnected between the input transducer 11 and the output transducer 19.

The hearing device 1 in FIG. 1 is an in-the-canal device (ITC), in particular a completely-in-the-canal device (CIC). Nevertheless, the invention is as well applicable to behind-the-ear devices (BTE), implanted devices or others.

In the case shown in FIG. 1, one or both of the transducers 11,19 are located outside the ear canal 80, e.g., near the user's concha.

Incoming acoustical sound 2, typically from the environment surrounding the user, has near the input transducer 11 a signal pressure level $SPL_{in}$ and is converted into audio signals 21 by the input transducer 11. These audio signals are, after optional further processing, fed into the signal processor 15, in which an amplification takes place as will be discussed below. The term amplification is meant in a general sense and comprises attenuation as well; it may be considered "dynamics processing", and the signal processor 15 may be considered an amplifier or a dynamics processor.

The signal processor 15 outputs processed audio signals 25, which, after optional further processing, are fed to the output transducer 19, where they are converted into outgoing acoustical sound 3. That outgoing acoustical sound 3 has an SPL depicted as $SPL_{out}$ and impinges on the user's ear drum 90, so that the user can perceive what has been output by the hearing device 1.

A portion of the incoming acoustical sound 2, which propagates to the user's ear drum as acoustical sound, is referred to as "direct sound" 4. That direct sound 4 is mainly sound waves travelling within and through the ear canal 80, but also comprises sound waves conducted through bones of the user's head. The sound waves travelling in air in the ear canal 80 may, e.g., travel through a vent of the hearing device 1, or are hardly or only little influenced by the hearing device 1 when the hearing device 1 is an open-canal device. The SPL of the direct sound 4 near the ear drum 90 is named $SPL_{direct}$.

In the ear canal 80 near the ear drum 90, the direct sound 4 and the sound output from the hearing device 1 interfere, and their superposition, which is depicted in FIG. 1 as dotted curves, has an SPL named $SPL_{sum}$.

Often, the ear canal 80 is strongly blocked by the hearing device 1, mainly in order to prevent feedback from the outgoing acoustic waves 3 to the input transducer 11. But at least at high input SPLs $SPL_{in}$, some leakage of direct sound 4 and its perception is unavoidable. In case of large vents and open-canal devices (open fitting), the amount of direct sound 4 is considerable.

Figure 2:
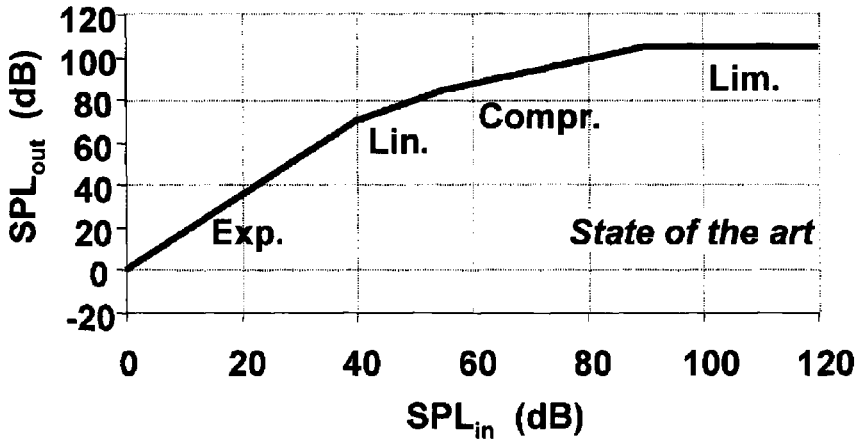
Fig. 2 PRIOR ART
FIG. 2 an SPL-related input-output characteristic like known in the art, schematically.

FIG. 2 shows schematically an SPL-related input-output characteristic as it might be known in the art. The SPL-related input-output characteristic describes the output SPL $SPL_{out}$ as a function of the input SPL $SPL_{in}$. The SPLs are given in dB, as is practice in the technical field.

The known dynamics processing comprises expansion "Exp.", linear ranges "Lin.", compression "Compr." and limiting "Lim.". Expansion may help to suppress low signals; in a linear range, amplification is constant; compression reduces the dynamics and may help to adapt to restricted dynamics perception capabilities of the user; and limiting restricts the maximum output, so as to avoid, e.g., exceeding the hearing device's limit for distortion-free output or feeding uncomfortably loud signals to the user.

Figure 3:
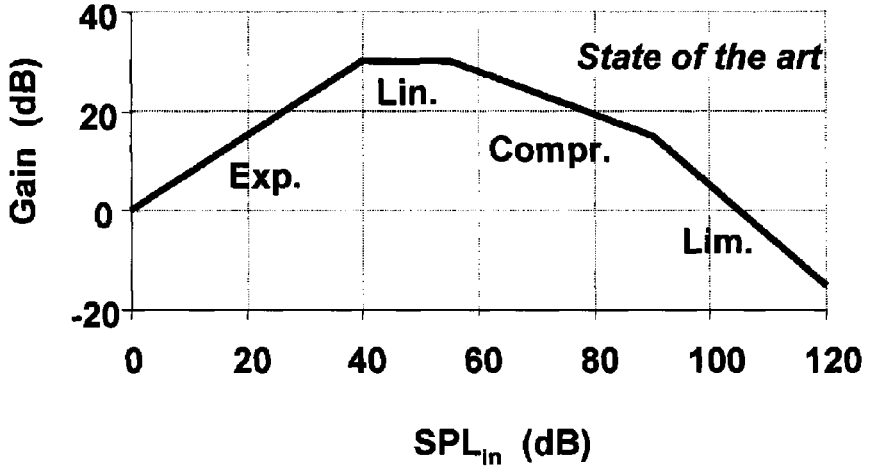
Fig. 3 PRIOR ART
FIG. 3 an SPL-related input-gain characteristic like known in the art, corresponding to the SPL-related input-output characteristic of FIG. 2, schematically.

FIG. 3 shows schematically an SPL-related input-gain characteristic as it might be known in the art, and which corresponds to the input-output characteristic of FIG. 2. The input-gain characteristic describes the SPL-related gain of the hearing device as a function of $SPL_{in}$. The gains are given in dB, as is practice in the technical field.

In the range of expansion "Exp.", the slope of the input-gain characteristic is greater than zero; in the linear range, the slope is zero; in the compression range, it is between zero and −1; and in the limiting range, it is −1.

Figure 4:
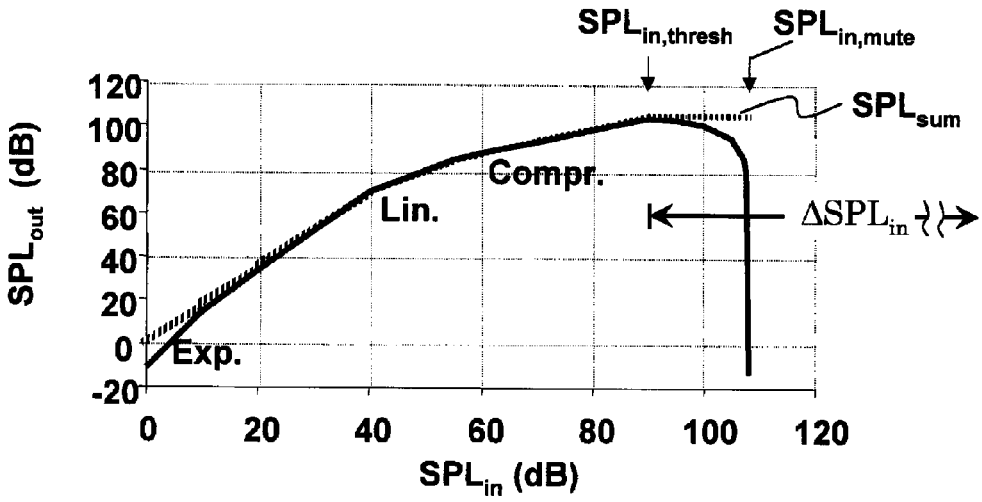
FIG. 4 an SPL-related input-output characteristic according to the invention.
Figure 5:
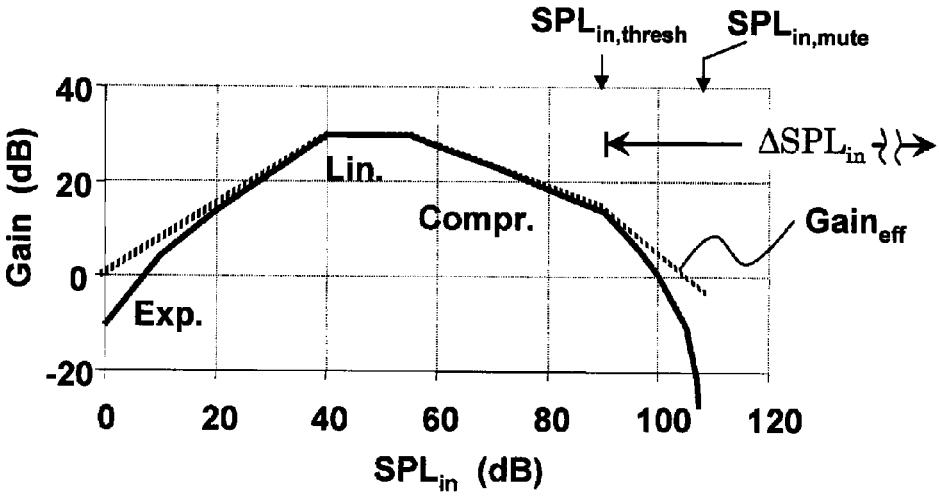
FIG. 5 an SPL-related input-gain characteristic according to the invention, corresponding to the SPL-related input-output characteristic of FIG. 4.

FIGS. 4 and 5 show, in the same manner as FIGS. 2 and 3, an SPL-related input-output characteristic according to the invention and an SPL-related input-gain characteristic according to the invention, corresponding to the input-output characteristic of FIG. 4.

In an input SPL range $\Delta SPL_{in}$, which extends from an input threshold SPL named $SPL_{in,thresh}$ to higher input SPLs, $SPL_{out}$ decreases with increasing $SPL_{in}$ (FIG. 4). In FIG. 5, this manifests in a slope smaller than −1.

In FIG. 4, a dashed curve is drawn, which depicts $SPL_{sum}$ as a function of $SPL_{in}$. That curve is a calculated curve with some assumptions about the amount of direct sound. The shape of the curve describing $SPL_{out}$ as a function of $SPL_{in}$ has, in the case of FIG. 4, been chosen such that $SPL_{sum}$ as a function of $SPL_{in}$ has a range (within $\Delta SPL_{in}$), in which it is constant. The size of that range has been made rather large by maximally reducing $SPL_{out}$ at an input SPL named $SPL_{in,mute}$, i.e. by totally muting the output from the hearing device there. Note that $SPL_{sum}$ will rise with higher input SPLs, since $SPL_{direct}$ increases (typically proportionally) with $SPL_{in}$ (not shown in FIG. 4).

In FIG. 5 can be seen, that, at above $SPL_{in,thresh}$, the slope of the gain is lower than −1, and that gain rapidly decreases (towards minus infinity) at $SPL_{in,mute}$. The dashed curve in FIG. 5 corresponds to the dashed curve in FIG. 4 and depicts the effective gain, which takes into account $SPL_{sum}$, i.e., the superposition of the hearing device output and the direct sound.

Figure 6:
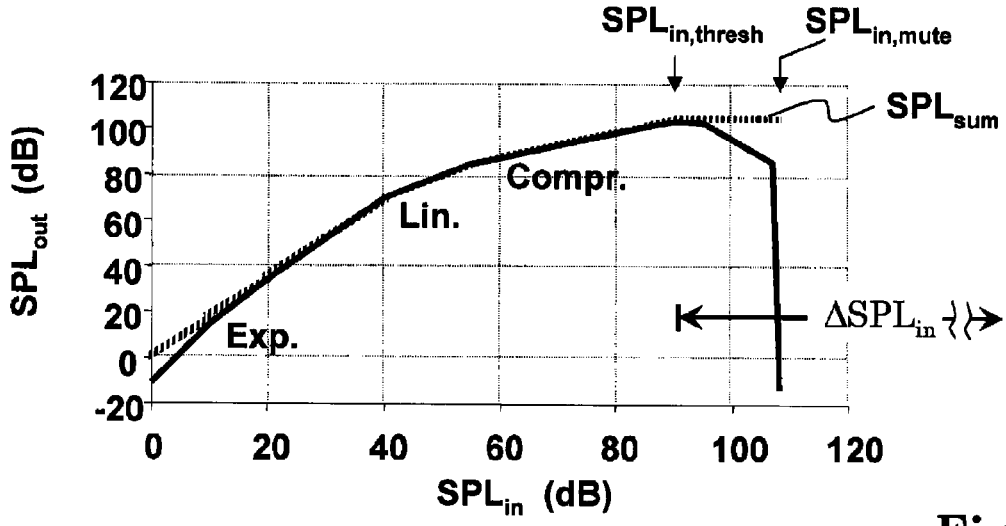
FIG. 6 an SPL-related input-output characteristic according to the invention.
Figure 7:
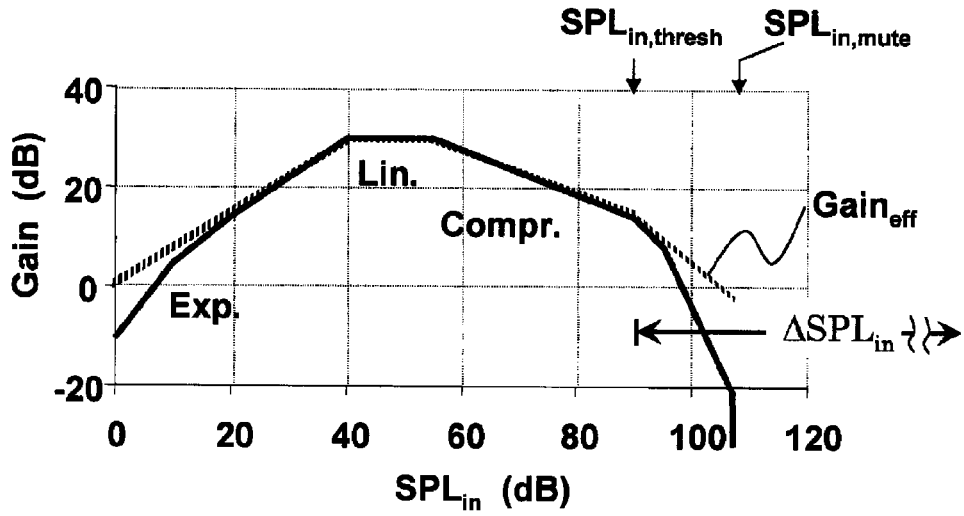
FIG. 7 an SPL-related input-gain characteristic according to the invention, corresponding to the SPL-related input-output characteristic of FIG. 6.

FIGS. 6 and 7 show another example of possible SPL-related output- and corresponding gain-curves according to the invention. The main difference between the curves of FIGS. 4,5 and FIGS. 6,7 is, that the curves in FIGS. 4,5 are, at least within $\Delta SPL_{in}$, rather smooth, whereas the curves in FIGS. 6,7 are made of a number of rather straight (rather linear) segments.

The shape of the curves, also outside the range $\Delta SPL_{in}$, may be chosen in various ways. An important parameter (or set of parameters) for the invention describes, where to arrange $\Delta SPL_{in}$, i.e., describes the $\Delta SPL_{in}$, to choose. In particular, the lower input SPL, from which $\Delta SPL_{in}$ starts ($SPL_{in,thresh}$), may be chosen according to various aspects, some of which will be discussed below.

Figure 8:
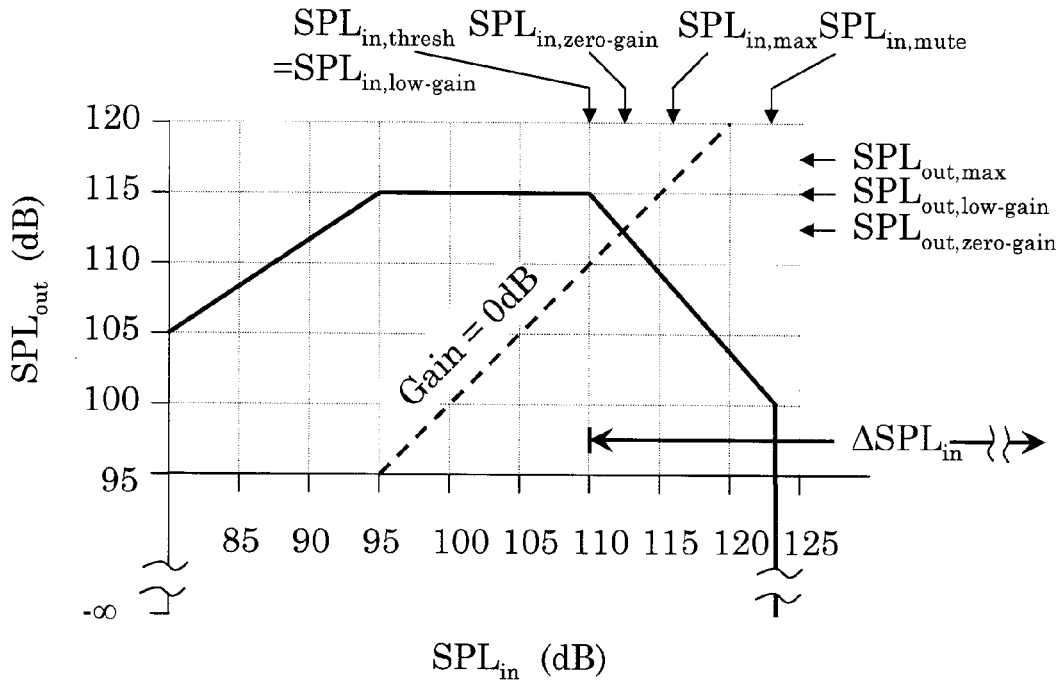
FIG. 8 an SPL-related input-output characteristic according to the invention.

FIG. 8 shows another possible SPL-related input-output characteristic according to the invention in the same manner as FIGS. 4 and 6. A dashed curve indicating where $SPL_{in}=SPL_{out}$ applies, i.e., where gain=0 dB is fulfilled, is also shown. The value of $SPL_{in,thresh}$ has been chosen such that it is smaller than (or at most equal to) a value $SPL_{in,max}$, above which the input transducer tends to produce distorted signals. That value $SPL_{in,max}$ is also sometimes referred to as maximum input power, MIP. Accordingly, by means of the invention, distorted signals can be damped or even muted.

Furthermore, the value of $SPL_{in,thresh}$ has been chosen such that the corresponding output value (and actually all output values $SPL_{out}$) are below (or at most equal to) a value $SPL_{out,max}$, above which the output transducer tends to distortions.

Furthermore, the value of $SPL_{in,thresh}$ according to FIG. 8 has been chosen equal to value named $SPL_{in,low\text{-}gain}$, which is, within some dB (as shown within about 5 dB) equal to its corresponding output SPL, named $SPL_{out,low\ gain}$. Another example for an $SPL_{in,low\ gain}$ is $SPL_{in,zero\ gain}$, which is (within 0 dB) equal to its corresponding output SPL, named $SPL_{out,zero\text{-}gain}$.

Figure 9:
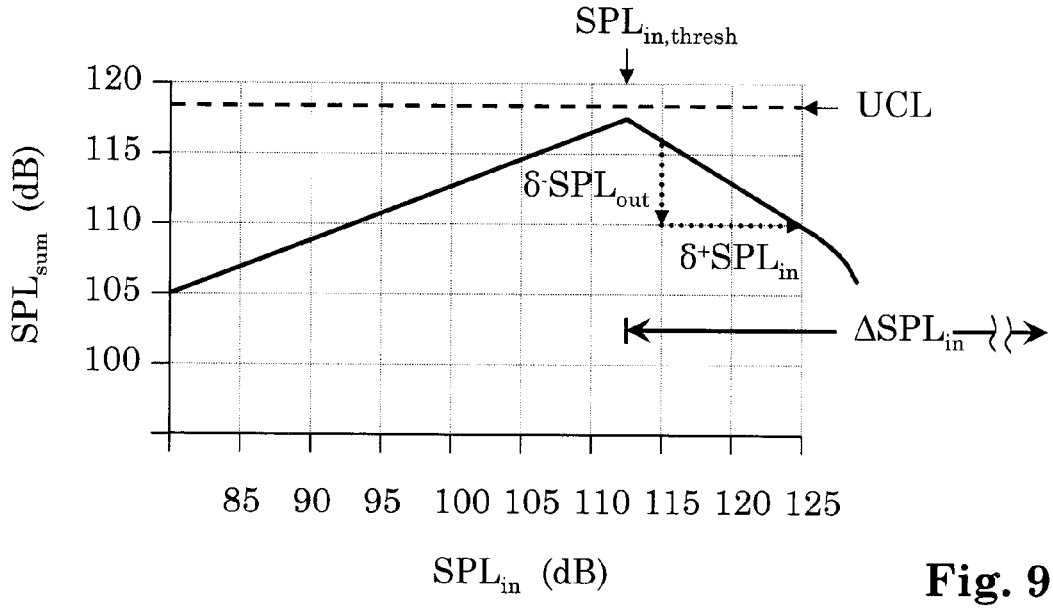
FIG. 9 an SPL-related input-output characteristic according to the invention.

FIG. 9 shows another possible SPL-related input-output characteristic according to the invention in the same manner as FIGS. 5 and 7. In this case, the value of $SPL_{in,thresh}$ has been chosen such that it is smaller than (or at most equal to) an uncomfortable level (UCL). The perception of sound with an SPL above the UCL is disagreeable or even painful to a user (in particular if the threshold of pain is reached or exceeded).

By means of dotted arrows, an important point of the invention is visualized in FIG. 9: There exists the input SPL range $\Delta SPL_{in}$, in which an increase $\delta^{+}SPL_{in}$ results in (or corresponds to) a decrease $\delta^{-}SPL_{out}$ in output SPL.

Figure 10:
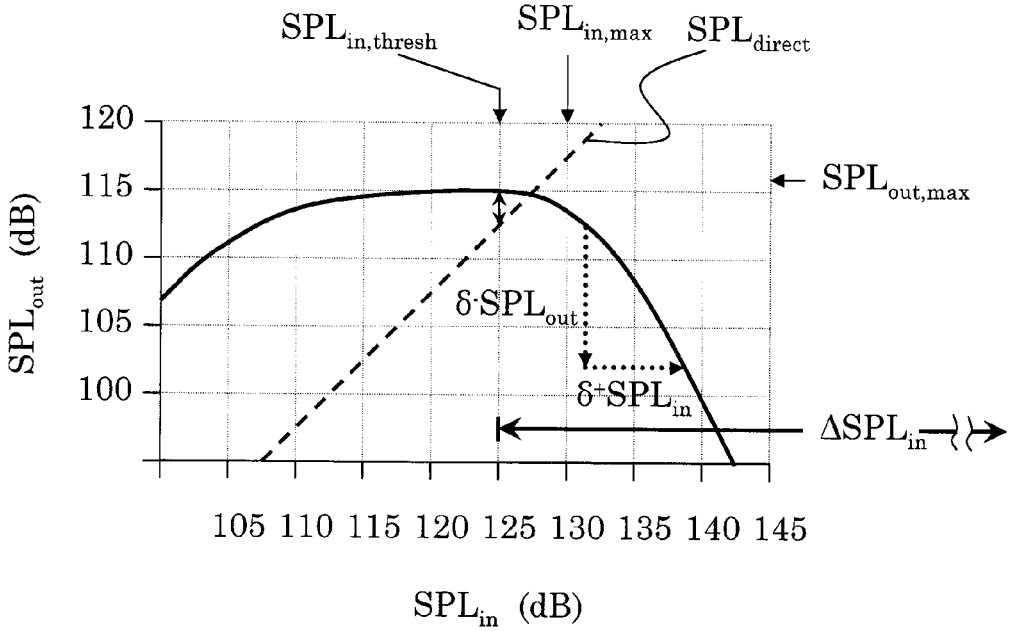
FIG. 10 an SPL-related input-output characteristic according to the invention.

FIG. 10 shows another possible SPL-related input-output characteristic according to the invention in the same manner as FIGS. 4, 6 and 8. Instead of being made up of rather linear segments, the curve is rather smooth. In FIG. 10, a dashed line indicates the SPL of direct sound $SPL_{direct}$. A 12.5 dB damping of the direct sound with respect to the incoming acoustical sound has been assumed.

In FIG. 10, the value of $SPL_{in,thresh}$ has been chosen as an input SPL, for which the corresponding output SPL ($SPL_{out}$) in dB minus the corresponding SPL ($SPL_{direct}$) of direct sound near the user's ear drum in dB is smaller than or equal to +6 dB. One could also choose $SPL_{in,thresh}$ such that that difference is smaller than or equal to 0 dB, or smaller than or equal to −6 dB. In the depicted case, said difference is about +2.5 dB.

Furthermore, it is depicted in FIG. 10, that the value of $SPL_{in,thresh}$ has also been chosen such that (as depicted in FIG. 8), distortions are minimized (see $SPL_{in,max}$ and $SPL_{out,max}$). As can be seen in FIG. 10, it is not necessary, that there is an $SPL_{mute}$ at (and usually above) which the output of the hearing device is fully suppressed.

In a simple case of the invention, it is possible to use basically the full audio signal 21 (as output from the input transducer 11) and to amplify or damp that full audio signal 21 in the DSP 15 (cf. FIG. 1). Yet, it is not necessarily so that the audio signal having the $SPL_{in}$ as depicted in FIGS. 4 to 10 has to be the same as the audio signal that is dynamically processed in the signal processor. I.e., in said FIGS. 4 to 10, the y-axis and the x-axis may refer to (different or same) portions of the audio signal 21 obtained by the input transducer 11.

Figure 11:
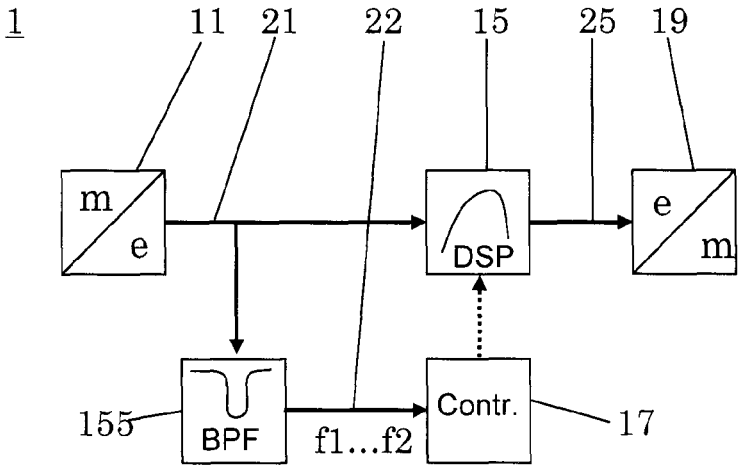
FIG. 11 a block diagram of a hearing device, schematically.

For example, as shown in FIG. 11, it is possible to use one portion of the audio signal, e.g., that portion, which lies in a certain frequency range, for the x-axis, and another portion, e.g., the full audio signal 21 to be dynamics-processed according to said portion. In FIG. 11, the (optionally already processed) audio signal 21 is fed into a band pass filter 155, which lets through only frequencies in a range f1 to f2. The audio signal output from the band pass filter 155, labelled 22, is fed into a controller 17, which may be a part of the signal processor 15. The controller 17 feeds a control signal (dashed arrow) to the signal processor 15. The full audio signal 21, which is also fed to the signal processor 15 is then dynamics-processed in the signal processor 15 according to the control signal. I.e., when the level of the band-filtered audio signal 22 reaches and exceeds a certain threshold value (corresponding to $SPL_{in,thresh}$), the amplitude if the full audio signal 21 will be reduced. Whether or not portions outside the frequency range f1 to f2 have very high (or low) amplitudes or not will in that case not, influence the dynamics processing and gain in the signal processor 15.

Figure 12:
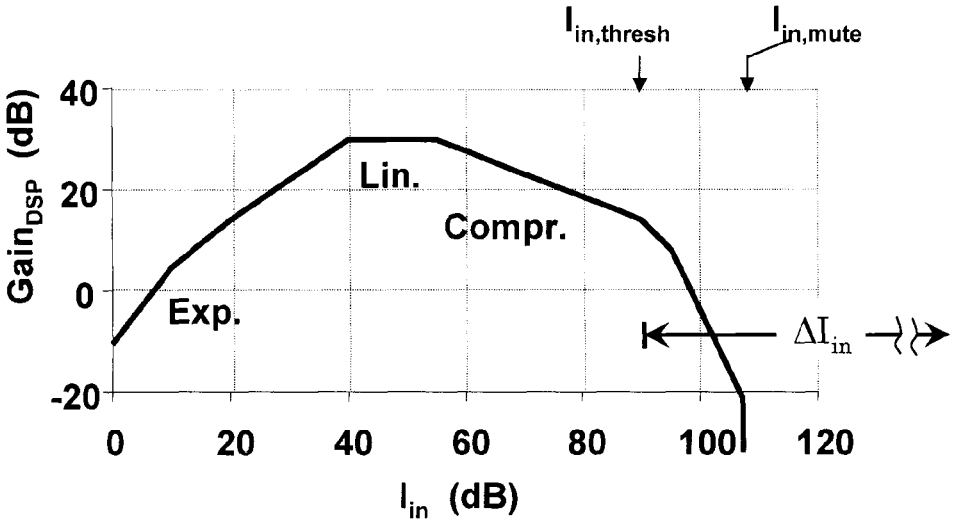
FIG. 12 a level-related input-gain characteristic of a signal processor according to the invention.

FIG. 12 shows a possible level-related input-gain characteristic of a signal processor according to the invention. It shows the functional relation between a gain (in dB) of the signal processor (named $gain_{DSP}$ in order to distinguish it from the SPL-related gains of the FIGS. 3, 5 and 7) and an input level $I_{in}$ (in dB). $I_{in}$ could be given in mV, mA or bits or other units. Referring to FIG. 11, the input level $I_{in}$ could be the control signal fed from the controller 17 to the signal processor 15, i.e., it only depends on the level in the frequency range f1 to f2. But, the corresponding $gain_{DSP}$ will be used for processing not only the audio signal 22 (in the frequency range f1 to f2), but the (full) audio signal 21. Above an input level $I_{in,thresh}$ the $gain_{DSP}$ will decrease with a slope smaller than −1 or, in other words, an increase in input level $I_{in}$ (of audio signal 22) will result in a decrease in output level (of audio signal 21).

Figure 13:
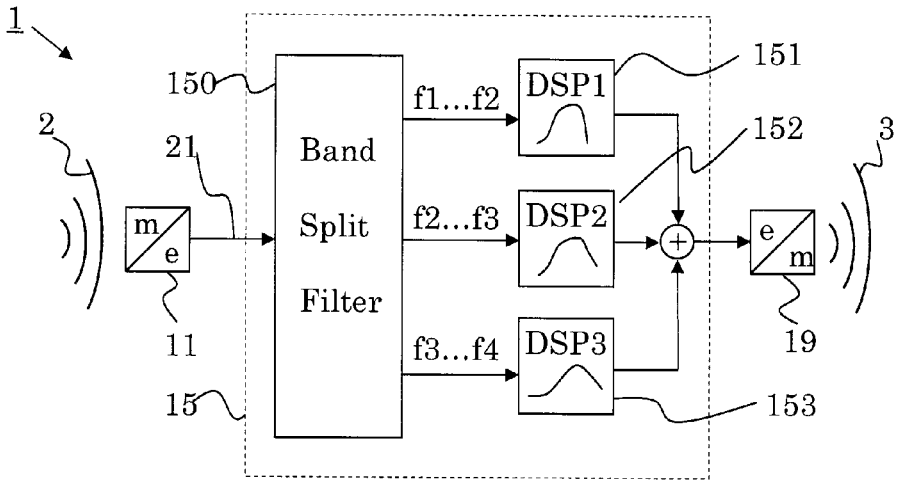
FIG. 13 a block diagram of a hearing device, schematically.

Another way of implementing the invention is sketched in FIG. 13. FIG. 13 shows schematically a block diagram of a hearing device. In this case, a band split filter 150 divides the audio signal 21 into a number of audio signals, three as depicted in FIG. 13, which correspond to the frequency bands f1 to f2, f2 to f3 and f3 to f4, respectively. One (partial) signal processor 151, 152 and 153, respectively, will process the dynamics of its respective (partial) audio signal. I.e., when an $I_{mute}$ in the frequency range f1 to f2 is reached, the $gain_{DSP}$ for processing the audio signal in the frequency range f1 to f2 will strongly reduce. The gain curves (and parameters like $I_{in,thresh}$, $I_{mute}$, . . . ) for the various partial signals may be identical or may be individual.

The outputs of the (partial) signal processors 151, 152, 153 is added to a sum signal, which is then fed to the output transducer 19 and converted into output acoustical sound 3.

Figure 14:
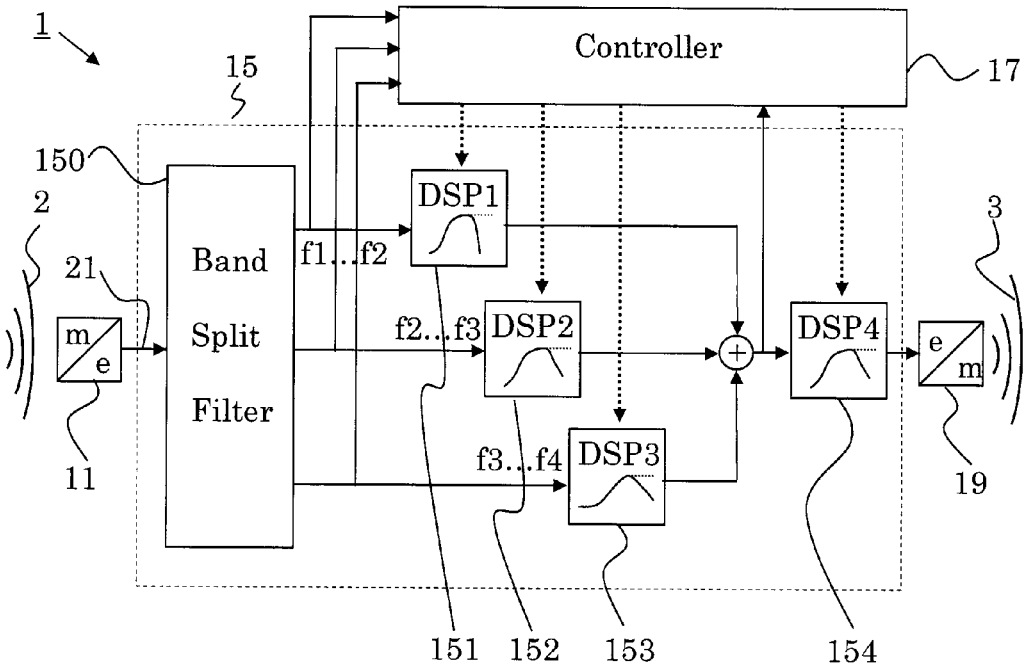
FIG. 14 a block diagram of a hearing device, schematically.

An even more complex and versatile embodiment is shown in FIG. 14. Like in FIG. 13, the audio signal 21 is splitted into a number of (e.g., three, possible at least 5, at least 8 or more) partial signals corresponding to frequency bands. The so-obtained signals are fed to (partial) signal processors 151, 152, 153 and to a controller 17. The outputs of the (partial) signal processors are added and fed to (an optional) signal processor 154. The added signal, which in fact can be any linear combination of the partial signals, is also fed to the controller 17 (which may be a part of the signal processor 15). The audio signal output from signal processor 154 is (after optional further processing) fed to the output transducer 19.

The controller 17 provides all the (partial) signal processors 151 to 154 with control signals (dashed arrows). Since the controller 17 receives all the above-mentioned audio signals, it is possible to use any algorithm on these for generating said control signals. For example, the embodiment of FIG. 13 may be realized by not-using signal processor 154 (constant gain) and providing (controlling) each of the other signal processors 151, 152, 153 with the level in that frequency range, with which it is fed, as input signal $I_{in}$.

Also the embodiment of FIG. 11 can be realized. E.g., by bypassing the partial signal processors 151, 152, 153 (constant gain), and providing (controlling) signal processor 154 only with the level in frequency range f1 to f2 as input signal $I_{in}$.

As another example, it is also possible to take the input level in the neighboring frequency band(s) into account and, accordingly, feed a part of the corresponding level to the (partial) signal processor 151, 152, and 153, respectively.

It is worthwhile to note that when frequency filtering is used, predetermined frequencies or automatically selected frequencies (and frequency ranges) may be used.

Besides using frequency filtering for splitting up audio signals, it is also possible to use other ways of classifying audio signals. Such are known in the field of hearing aids. E.g., classification in dependence of the time structure of the audio signals.

In a special embodiment of the invention, by means of which the problem of excessive direct sound disturbing the user can be solved, the hearing device will generate phase-reversed sound or "anti-sound", i.e., acoustical waves with reversed phase. The direct sound will at least partially be suppressed when it superposes with the phase-reversed sound. Accordingly, direct sound will have a decreased SPL. In order to suppress direct sound, an audio signal representative of the direct sound has to be obtained. This may be the audio signal 21 (confer FIG. 1), or a signal obtained by means of a mechanical-to-electrical converter located in the ear canal 80, preferably close to the ear drum 90 (cf. FIG. 1). That audio signal is processed (including reversing its phase) and fed to an electrical-to-mechanical-converter. The resulting phase-reversed acoustical waves are output near the user's ear drum 90 (cf. FIG. 1), where they superpose with the direct sound. Due to destructive interference, the resulting SPL is smaller than $SPL_{direct}$.

Nevertheless, it is possible to achieve a negative slope of input-SPL-to-output-SPL-characteristics of the hearing device without the generation of sound ("anti-sound") for suppressing direct sound through destructive interference, as has been shown above.

One advantage of this special embodiment is, that hearing device users can be protected from excessive environmental sound. In some environments, like, e.g., at rock concerts or at construction sites, the environmental sound may be so loud that the direct sound is disturbing or even painful ($SPL_{direct}$>UCL). This may in particular be the case with open-canal devices or hearing device with large vents. Decreasing $SPL_{direct}$ when $SPL_{direct}$ is large by adding phase-reversed sound is then very advantageous.

Accordingly, the hearing device may on the one hand work as a hearing aid or communication device or the like, and on the other hand as a hearing protection device (using said reversed-phase sound).

In particular, it is possibly by means of the special embodiment to use the phase-reversed sound for achieving an enlarged $SPL_{in}$-range, in which $SPL_{sum}$ does not rise. That $SPL_{in}$-range is enlarged with respect to what can be achieved without anti-phase sound (cf. FIGS. 4 and 6).

The generation and use of phase-reversed sound is described in more detail in EP 1 499 159 A2 and in WO 2005/052911. Therefore, these two documents are herewith incorporated by reference in this application.

LIST OF REFERENCE SYMBOLS

1 hearing device, hearing aid

11 input transducer, mechanical-to-electrical converter, microphone

15 signal processor, DSP, non-linear amplifier
150 filter, band split filter
151,152,153,154 (partial) signal processor, non-linear amplifier
155 filter, band pass filter
17 controller
19 output transducer, electrical-to-mechanical converter, loudspeaker, receiver
2 incoming acoustical sound, incoming sound waves, environmental sound
21,22 audio signals
25 audio signals, processed audio signals
3 outgoing acoustical sound, outgoing acoustic waves
4 direct sound
80 ear canal
90 sensing element of the ear, ear drum
Compr. compression (less than proportionally decreasing gain)
Exp. expansion (increasing gain)
f1,f2,f3,f4 frequencies
Gain SPL-related gain of hearing device
$gain_{DSP}$ level-related gain of the signal processor
$Gain_{eff}$ SPL-related effective gain, SPL-related gain considering both, hearing device gain and direct sound
$I_{in}$ input level
$I_{in,thresh}$ input threshold level
$I_{in,mute}$ input level, above which output is muted
Lim. limiting (proportionally decreasing gain)
Lin. linear range (constant gain)
SPL sound pressure level
$SPL_{in}$ input SPL, SPL of acoustic waves entering the input transducer
$SPL_{in,max}$ maximum input SPL (MPI), limit for distortion in input transducer
$SPL_{in,low\text{-}gain}$ input SPL, which is, within 6 dB or 3 dB, equal to its corresponding output SPL $SPL_{out,low\text{-}gain}$
$SPL_{in,thresh}$ input threshold SPL
$SPL_{in,mute}$ input SPL, above which output is muted
$SPL_{in,zero\text{-}gain}$ input SPL, which is equal to its corresponding output SPL $SPL_{out,zero\text{-}gain}$
$SPL_{direct}$ SPL of direct sound
$SPL_{out}$ output SPL, SPL of acoustic waves leaving the output transducer
$SPL_{out,low\text{-}gain}$ see $SPL_{in,low\text{-}gain}$
$SPL_{out,max}$ maximum output SPL (MPO), limit for distortion in output transducer
$SPL_{out,zero\text{-}gain}$ output SPL, which is equal to its corresponding input SPL $SPL_{in,zero\text{-}gain}$
$SPL_{sum}$ SPL of a superposition of outgoing acoustical sound and direct sound near the user's ear drum (or other sensing element of the ear)
UCL uncomfortable level
$\delta^{+}SPL_{in}$ increase in input SPL
$\delta^{-}SPL_{out}$ decrease in output SPL
$\Delta SPL_{in}$ input level range
$\Delta SPL_{in}$ input SPL range

The invention claimed is:

1. Hearing device to be worn by a user of the hearing device, comprising an input transducer for transducing incoming acoustical sound into audio signals;

a signal processor for processing said audio signals or audio signals derived therefrom, and for outputting processed audio signals; and an output transducer for transducing said processed audio signals or audio signals derived therefrom into outgoing acoustical sound;

wherein said signal processor embodies an open-loop control designed such that there exists an input SPL range of at least a portion of said incoming acoustical sound, in which an increase in input SPL of said at least one portion of said incoming acoustical sound results in a decrease in output SPL of at least a portion of said outgoing acoustical sound;

wherein SPL stands for sound pressure level.

2. Hearing device according to claim 1, wherein within said input SPL range there exists an input SPL above which the output of said least one portion of said outgoing acoustical sound is muted.

3. Hearing device according to claim 1, wherein said input SPL range extends from an input threshold SPL to higher SPLs.

4. Hearing device according to claim 3, wherein said decrease in output SPL is chosen such that an SPL of a superposition of said outgoing acoustical sound and direct sound near the user's ear drum is, within ±6 dB, a constant for input SPLs of said at least one portion of said incoming acoustical sound above said input threshold SPL, as far as the corresponding SPL of said direct sound is not larger than said constant, wherein said direct sound is incoming acoustical sound reaching the user's ear drum.

5. Hearing device according to claim 3, wherein for all input SPLs of said at least one portion of said incoming acoustical sound above said input threshold SPL, the corresponding output SPL of said at least one portion of said incoming acoustical sound is at most as large as the largest output SPL of said at least one portion of said outgoing acoustical sound for any input SPL of said at least one portion of said incoming acoustical sound equal to or below said input threshold SPL.

6. Hearing device according to claim 3, wherein said input threshold SPL is chosen such that an SPL of a superposition of said outgoing acoustical sound and direct sound near the user's ear drum is below the user's uncomfortable level, wherein said direct sound is incoming acoustical sound reaching the user's ear drum.

7. Hearing device according to claim 3, wherein said input threshold SPL is an input SPL for which the corresponding output SPL in dB minus the corresponding SPL of direct sound near the user's ear drum in dB is smaller than or equal to +6 dB, wherein said direct sound is incoming acoustical sound reaching the user's ear drum.

8. Hearing device according to claim 3, wherein said input threshold SPL is chosen equal to an input SPL which is, within 6 dB, equal to its corresponding output SPL.

9. Hearing device according to claim 3, wherein said input transducer tends to produce distorted input audio signals for input SPLs of said at least one portion of said incoming acoustical sound above a maximum input SPL, and wherein said input threshold SPL is smaller than or equal to said maximum input SPL.

10. Hearing device according to claim 3, wherein said output transducer tends to produce distorted outgoing acoustical sound for output SPLs of said at least one portion of said outgoing acoustical sound above a maximum output SPL, and wherein said input threshold SPL is chosen such that, as output SPL of said at least one portion of said outgoing acoustical sound, at most said maximum output SPL is reached.

11. Hearing device according to claim 1, which is an open canal device.

12. Hearing device according to claim 1, which is a hearing aid.

13. Hearing device according to claim 1, wherein said at least one portion of said incoming acoustical sound is said incoming acoustical sound, which is transduced by said input transducer.

14. Hearing device according to claim 1, wherein said at least one portion of said outgoing acoustical sound is said outgoing acoustical sound as transduced by said output transducer.

15. Hearing device according to claim 1, wherein said at least one portion of said incoming acoustical sound is obtained by filtering in at least a first frequency range.

16. Hearing device according to claim 1, wherein said at least one portion of said outgoing acoustical sound is obtained by filtering in at least a second frequency range.

17. Hearing device according to claim 15, wherein said at least one portion of said outgoing acoustical sound is obtained by filtering in at least a second frequency range, and wherein said first and second frequency ranges are identical.

18. Method of operating a hearing device, said method comprising the steps of:

receiving incoming acoustical sound;

transducing said incoming acoustical sound into audio signals;

processing said audio signals or audio signals derived therefrom, and outputting processed audio signals;

transducing said processed audio signals or audio signals derived therefrom into outgoing acoustical sound to be presented to a user of the hearing device; and changing a level of said audio signals obtained from said incoming acoustical sound in such a way by means of open-loop control that an increase in input SPL of at least a portion of said incoming acoustical sound results in a decrease in output SPL of at least a portion of said outgoing acoustical sound, wherein SPL stands for sound pressure level.

19. Method of fitting a hearing device comprising an input transducer for transducing incoming acoustical sound into audio signals, said method comprising the step of adjusting at least one parameter of a signal processor of said hearing device, wherein said signal processor embodies an open-loop control designed such that there exists an input SPL range of at least a portion of said incoming acoustical sound, in which an increase in input SPL of said at least one portion of said incoming acoustical sound results in a decrease in output SPL of at least a portion of said outgoing acoustical sound, wherein SPL stands for sound pressure level.

20. Method according to claim 18, wherein said at least one parameter is one selected from the group consisting of:

an input threshold SPL limiting said input SPL range;

an input SPL above which the output of said at least one portion of said outgoing acoustical sound is muted; and a parameter of a parameter set describing to which extent and/or in which form said decrease in output SPL of said at least one portion of said outgoing acoustical sound depends on said increase in input SPL of said at least one portion of said incoming acoustical sound.

21. Hearing device according to claim 5, wherein said decrease in output SPL is chosen such that an SPL of a superposition of said outgoing acoustical sound and direct sound near the user's ear drum is within ±3 dB.

22. Hearing device according to claim 6, wherein the corresponding output SPL of said at least one portion of said incoming acoustical sound is smaller than the largest output SPL of said at least one portion of said outgoing acoustical sound for any input SPL of said at least one portion of said incoming acoustical sound equal to or below said input threshold SPL.

23. Hearing device to be worn by a user of the hearing device, comprising an input transducer for transducing incoming signals into audio signals;

a signal processor for processing said audio signals or audio signals derived therefrom, and for outputting processed audio signals; and an output transducer for transducing said processed audio signals or audio signals derived therefrom into outgoing acoustical sound;

wherein said signal processor embodies an open-loop control designed such that there exists an input level range of at least a portion of said incoming signal, in which an increase in input level of said at least one portion of said incoming signal results in a decrease in output level of at least a portion of said outgoing acoustical sound.

24. Method of operating a hearing device, said method comprising the steps of:

receiving incoming signals;

transducing said incoming signals into audio signals;

processing said audio signals or audio signals derived therefrom, and outputting processed audio signals;

transducing said processed audio signals or audio signals derived therefrom into outgoing acoustical sound to be presented to a user of the hearing device; and changing a level of said audio signals obtained from said incoming signals in such a way by means of open-loop control that an increase in input level of at least a portion of said incoming signals results in a decrease in output level of at least a portion of said outgoing acoustical sound.

25. Method of fitting a hearing device comprising an input transducer for transducing incoming signals into audio signals, said method comprising the step of adjusting at least one parameter of a signal processor of said hearing device, wherein said signal processor embodies an open-loop control designed such that there exists an input level range of at least a portion of said incoming signals, in which an increase in input level of said at least one portion of said incoming signals results in a decrease in output level of at least a portion of said outgoing acoustical sound.

26. Hearing device to be worn by a user of the hearing device, comprising an input transducer for transducing incoming acoustical sound into audio signals;

a signal processor for processing said audio signals or audio signals derived therefrom, and for outputting processed audio signals; and an output transducer for transducing said processed audio signals or audio signals derived therefrom into outgoing acoustical sound;

wherein said signal processor is designed such that there exists an input SPL range of at least a portion of said incoming acoustical sound, in which an increase in input SPL of said at least one portion of said incoming acoustical sound results in a decrease in output SPL of at least a portion of said outgoing acoustical sound;

wherein SPL stands for sound pressure level;

wherein within said input SPL range there exists an input SPL above which the output of said least one portion of said outgoing acoustical sound is muted.

27. Method of operating a hearing device, said method comprising the steps of:

receiving incoming acoustical sound;

transducing said incoming acoustical sound into audio signals;

processing said audio signals or audio signals derived therefrom, and outputting processed audio signals;

transducing said processed audio signals or audio signals derived therefrom into outgoing acoustical sound to be presented to a user of the hearing device; and changing a level of said audio signals obtained from said incoming acoustical sound in such a way that an increase in input SPL of at least a portion of said incoming acoustical sound results in a decrease in output SPL of at least a portion of said outgoing acoustical sound, wherein SPL stands for sound pressure level, and wherein there exists an input SPL above which the output of said least one portion of said outgoing acoustical sound is muted.

* * * * *